US007017491B2

(12) United States Patent
Edamitsu

(10) Patent No.: US 7,017,491 B2
(45) Date of Patent: Mar. 28, 2006

(54) PRINTING APPARATUS HAVING PLATE DISCHARGE MECHANISM WITH AIR BLOWING UNIT

(75) Inventor: Kenji Edamitsu, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 11/088,741

(22) Filed: Mar. 25, 2005

(65) Prior Publication Data

US 2005/0235855 A1 Oct. 27, 2005

(30) Foreign Application Priority Data

Apr. 26, 2004 (JP) ..... 2004-129347
Jan. 13, 2005 (JP) ..... 2005-005826

(51) Int. Cl.
*B41L 47/14* (2006.01)
*B65H 29/24* (2006.01)

(52) U.S. Cl. ..... 101/477; 271/209; 271/211; 271/309; 271/188

(58) Field of Classification Search ..... 101/477, 101/480; 271/207, 209, 211, 194, 195, 306, 271/309, 188; 414/792.7, 794.4
See application file for complete search history.

(56) References Cited

U.S. PATENT DOCUMENTS 3,793,950 A * 2/1974 Kaneko et al. ..... 101/142
4,811,547 A * 3/1989 Raats et al. ..... 53/284.4
5,553,543 A * 9/1996 Takahashi et al. ..... 101/409
6,112,663 A * 9/2000 Ulrich et al. ..... 101/389.1
6,397,751 B1 * 6/2002 Ramsay ..... 101/477
6,626,109 B1 * 9/2003 Kundgen et al. ..... 101/477

FOREIGN PATENT DOCUMENTS

DE 199 38 086 A1 * 2/2001
JP 4-332678 * 11/1992
JP 2002-370863 A 12/2002
JP 2003-192182 A 7/2003
JP 2003-266639 A 9/2003

* cited by examiner

*Primary Examiner*—Leslie J. Evanisko
(74) *Attorney, Agent, or Firm*—McDermott Will & Emery LLP

(57) ABSTRACT

A plate discharger includes a peeling claw, a transport device and an air blowing device. The transport device has a rotary shaft, first transport rollers rotatable about the rotary shaft, a driven rotary shaft connected to a drive gear meshed with and driven by a transmission gear disposed sideways from the first transport rollers, second transport rollers rotatable about the driven rotary shaft, peeling rollers pivotable about the rotary shaft, and belts wound around the first transport rollers and peeling rollers. When a printing plate is passed between the first transport rollers and second transport rollers, the air blowing device blows air to the undersurface of the printing plate.

20 Claims, 15 Drawing Sheets

PRINTING APPARATUS HAVING PLATE DISCHARGE MECHANISM WITH AIR BLOWING UNIT

BACKGROUND OF THE INVENTION

1. Field of the Invention

This invention relates to a printing apparatus having a plate discharge mechanism for transporting used printing plates mounted peripherally of a plate cylinder, and discharging the printing plates to a plate discharge station.

2. Description of the Related Art

A known printing apparatus having such a plate discharge mechanism includes transport rollers and transport belts for contacting opposite ends of used printing plates and transporting the printing plates from peripheries of a plate cylinder to a discharge station that stores the printing plates successively stacked one upon the other. This printing apparatus can reduce the space required for the plate discharge station.

However, ink and dampening water remain adhering to the surfaces of the printing plates used in printing. In such a printing apparatus, therefore, when used printing plates are discharged to the plate discharge station, a printing plate already stored in the plate discharge station contracts the ink and dampening water adhering to a next printing plate discharged to the plate discharge station. When such a phenomenon occurs, the viscosity of the ink and dampening water causes a cohesion between the printing plate already stored in the plate discharge station and the next printing plate discharged to the plate discharge station. The cohesion poses a problem of errors in transportation of the printing plates.

Japanese Unexamined Patent Publication No. 2003-266639 describes a printing apparatus including a clamp mechanism for pinching one end of each printing plate and drawing the printing plate. This construction prevents the errors in transportation of used printing plates, thereby reliably discharging the printing plates.

However, the printing apparatus described in the above publication requires the clamp mechanism for pinching an end of each printing plate, a moving mechanism for moving the clamp mechanism toward the plate discharge station from a position for pinching the end of the printing plate peeled from the plate cylinder, and an open/close mechanism for opening and closing the clamp mechanism in the position for pinching the end of the printing plate peeled from the plate cylinder and in the discharge station. Thus, the above printing apparatus is complicated in construction and is costly.

SUMMARY OF THE INVENTION

The object of this invention, therefore, is to provide a printing apparatus simple in construction, and yet capable of preventing errors in transportation of used printing plates.

The above object is fulfilled, according to this invention, by a printing apparatus having a plate discharge mechanism for removing used printing plates mounted peripherally of a plate cylinder from the plate cylinder, and discharging the printing plates to a plate discharge station that successively stores the printing plate as stacked one after another, the plate discharge mechanism comprising a transport device for passing the printing plates through a transport path disposed between the plate cylinder and the plate discharge station to discharge the printing plates to the plate discharge station, and an air blowing device for blowing air to an undersurface of each of the printing plates passing through the transport path.

This printing apparatus is simple in construction, and yet is capable of preventing errors in transportation of used printing plates.

In a preferred embodiment, the air blowing device is arranged to blow air at least to an undersurface in a forward region of each of the printing plates passing through the transport path.

The air blowing device may be arranged to blow air in a way to prevent a forward end of each of the printing plates from contacting a printing plate already stored in the plate discharge station.

In another aspect of the invention, the transport device includes a rotary shaft, a first transport roller rotatable about the rotary shaft, and having a larger diameter at opposite ends than in an intermediate portion thereof transversely of the printing plates, and a second transport roller rotatable synchronously with rotation of the first transport roller and arranged to pinch the printing plates with the first transport roller in portions of the printing plates between the opposite ends of the first transport roller.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
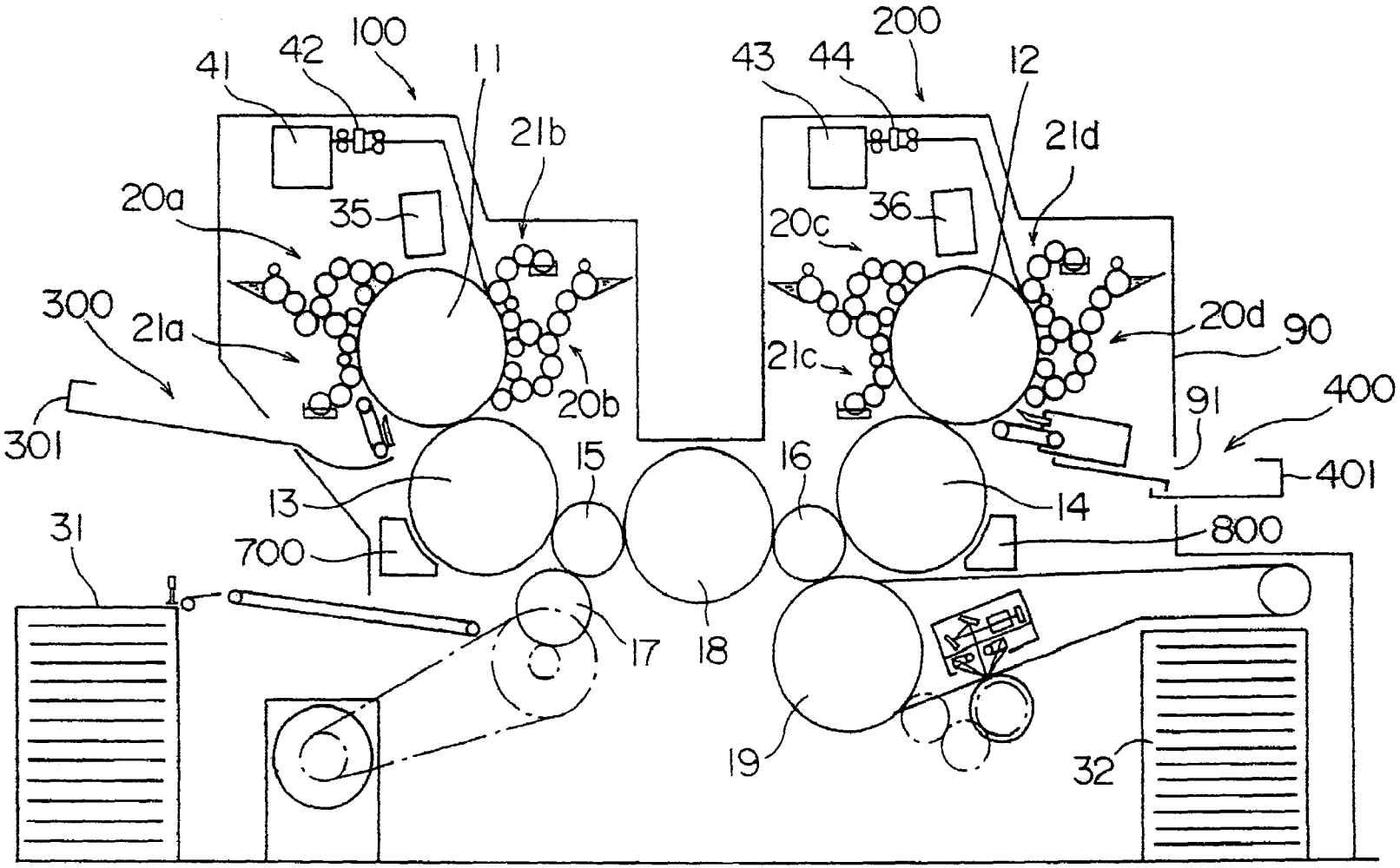
FIG. 1 is a schematic side view of a printing apparatus in a first embodiment of this invention.

Embodiments of this invention will be described hereinafter with reference to the drawings. FIG. 1 is a schematic side view of a printing apparatus in a first embodiment of this invention.

This printing apparatus records images on printing plates mounted, two each, on first and second plate cylinders 11 and 12 in a prepress process, feeds inks to the plates having the images recorded thereon, and transfers the inks from the plates through blanket cylinders to printing paper held on impression cylinders 15 and 16, thereby printing the images on the printing paper.

The printing apparatus has the first plate cylinder 11, the second plate cylinder 12, a plate feeder 100 for feeding printing plates to be mounted on the peripheral surface of the first plate cylinder 11, a plate feeder 200 for feeding printing plates to be mounted on the peripheral surface of the second plate cylinder 12, a plate discharger 300 for removing used printing plates from the peripheral surface of the first plate cylinder 11 and discharging the printing plates to a plate discharge cassette 301, a plate discharger 400 for removing used printing plates from the peripheral surface of the second plate cylinder 12 and discharging the printing plates to a plate discharge cassette 401, a first blanket cylinder 13 contactable with the first plate cylinder 11, a second blanket cylinder 14 contactable with the second plate cylinder 12, the first impression cylinder 15 contactable with the first blanket cylinder 13, and the second impression cylinder 16 contactable with the second blanket cylinder 14. The printing apparatus further includes a paper feed cylinder 17 for transferring printing paper supplied from a paper storage station 31 to the first impression cylinder 15, a transfer cylinder 18 for transferring the printing paper from the first impression cylinder 15 to the second impression cylinder 16, and a paper discharge cylinder 19 disposed adjacent the second impression cylinder 16.

The first impression cylinder 15 movable into contact with the first blanket cylinder 13 has half the diameter of the first plate cylinder 11 and first blanket cylinder 13. The second impression cylinder 16 movable into contact with the second blanket cylinder 14 has half the diameter of the second plate cylinder 12 and second blanket cylinder 14. The first and second impression cylinders 15 and 16 have grippers, not shown, for holding and transporting the forward end of printing paper.

The paper feed cylinder 17 disposed adjacent the first impression cylinder 15 has the same diameter as the first impression cylinder 15. The paper feed cylinder 17 has a gripper, not shown, for holding and transporting the forward end of each sheet of printing paper successively fed from the paper storage station 31. When the printing paper is transferred from the feed cylinder 17 to the first impression cylinder 15, the gripper of the first impression cylinder 15 holds the forward end of the printing paper which has been held by the gripper of the feed cylinder 17.

The transfer cylinder 18 disposed between the first impression cylinder 15 and second impression cylinder 16 has the same diameter as the first and second plate cylinders 11 and 12 and the first and second blanket cylinders 13 and 14. The transfer cylinder 18 has a gripper, not shown, for holding and transporting the forward end of the printing paper received from the first impression cylinder 15, and transferring the forward end of the printing paper to the gripper of the second impression cylinder 16.

The paper discharge cylinder 19 disposed adjacent the second impression cylinder 16 has the same diameter as the first and second plate cylinders 11 and 12 and the first and second blanket cylinders 13 and 14. The discharge cylinder 19 has a pair of chains wound around opposite ends thereof. The chains are interconnected by coupling members, not shown, having grippers arranged thereon. When the second impression cylinder 16 transfers the printing paper to the discharge cylinder 19, one of the grippers on the discharge cylinder 19 holds the forward end of the printing paper having been held by the gripper of the second impression cylinder 16. With movement of the chains, the printing paper is transported to a paper discharge station 32 to be discharged thereon.

The first and second impression cylinders 15 and 16, paper feed cylinder 17, paper discharge cylinder 19 and first and second blanket cylinders 13 and 14 are interlocked to one another through gears attached to ends thereof, respectively. Further, the first blanket cylinder 13 and first plate cylinder 11 are interlocked to each other, and the second blanket cylinder 14 and second plate cylinder 12 are interlocked to each other, through gears attached to ends thereof, respectively. Thus, the first and second plate cylinders 11 and 12, first and second impression cylinders 15 and 16, paper feed cylinder 17, paper discharge cylinder 19 and first and second blanket cylinders 13 and 14 are synchronously rotatable by a drive motor.

The first plate cylinder 11 is surrounded by an ink feeder 20*a* for feeding an ink of black (K), for example, to a printing plate mounted peripherally of the first plate cylinder 11, an ink feeder 20*b* for feeding an ink of magenta (M), for example, to a printing plate mounted peripherally of the first plate cylinder 11, a dampening water feeder 21*a* for feeding dampening water to areas of the printing plate to which the ink is to be fed from the ink feeder 20*a*, and a dampening water feeder 21*b* for feeding dampening water to areas of the printing plate to which the ink is to be fed from the ink feeder 20*b*. The second plate cylinder 12 is surrounded by an ink feeder 20*c* for feeding an ink of cyan (C), for example, to a printing plate mounted peripherally of the second plate cylinder 12, an ink feeder 20*d* for feeding an ink of yellow (Y), for example, to a printing plate mounted peripherally of the second plate cylinder 12, a dampening water feeder 21*c* for feeding dampening water to areas of the printing plate to which the ink is to be fed from the ink feeder 20*c*, and a dampening water feeder 21*d* for feeding dampening water to areas of the printing plate to which the ink is to be fed from the ink feeder 20*d*.

Further, arranged around the first and second plate cylinders 11 and 12 are the plate feeder 100 for feeding plates stored in a storage cassette 41 to the peripheral surface of the first plate cylinder 11, the plate feeder 200 for feeding plates stored in a storage cassette 43 to the peripheral surface of the second plate cylinder 12, an image recorder 35 for recording images on the plates mounted peripherally of the first plate cylinder 11, an image recorder 36 for recording images on the plates mounted peripherally of the second plate cylinder 12, the plate discharger 300 for removing used printing plates P from the peripheral surface of the first plate cylinder 11 and discharging the printing plates P to the plate discharge cassette 301, and the plate discharger 400 for removing used printing plates P from the peripheral surface of the second plate cylinder 12 and discharging the printing plates P to the plate discharge cassette 401.

A blanket cylinder cleaning device 700 and a blanket cylinder cleaning device 800 are arranged around the first blanket cylinder 13 and second blanket cylinder 14, respectively, for cleaning these blanket cylinders 13 and 14.

The plate feeder 100 extends between the storage cassette 41 for storing a printing plate stock in rolled form, and the first plate cylinder 11. The plate feeder 100 includes a cutter 42 for cutting the printing plate stock to a predetermined length, and a guide mechanism having a guide plate and transport rollers for transporting printing plates from the storage cassette 41 to the first plate cylinder 11. The plate feeder 200 extends between the storage cassette 43 for storing a printing plate stock in rolled form, and the second plate cylinder 12. The plate feeder 200 includes a cutter 44 for cutting the printing plate stock to a predetermined length, and a guide mechanism having a guide plate and transport rollers for transporting printing plates from the storage cassette 43 to the second plate cylinder 12. Each guide mechanism includes a support member 135 (FIG. 8), a presser 601 (FIG. 8) disposed on the support member 135 for pressing each printing plate to the peripheral surface of the first or second plate cylinder 11 or 12 immediately before the printing plate is clamped by a forward end clamp mechanism 50, and a presser moving mechanism 600 (FIG. 8) for moving the presser 601 between a position for contacting the peripheral surface of the first or second plate cylinder 11 or 12 and a position spaced from the peripheral surface of the first or second plate cylinder 11 or 12.

Figure 2:
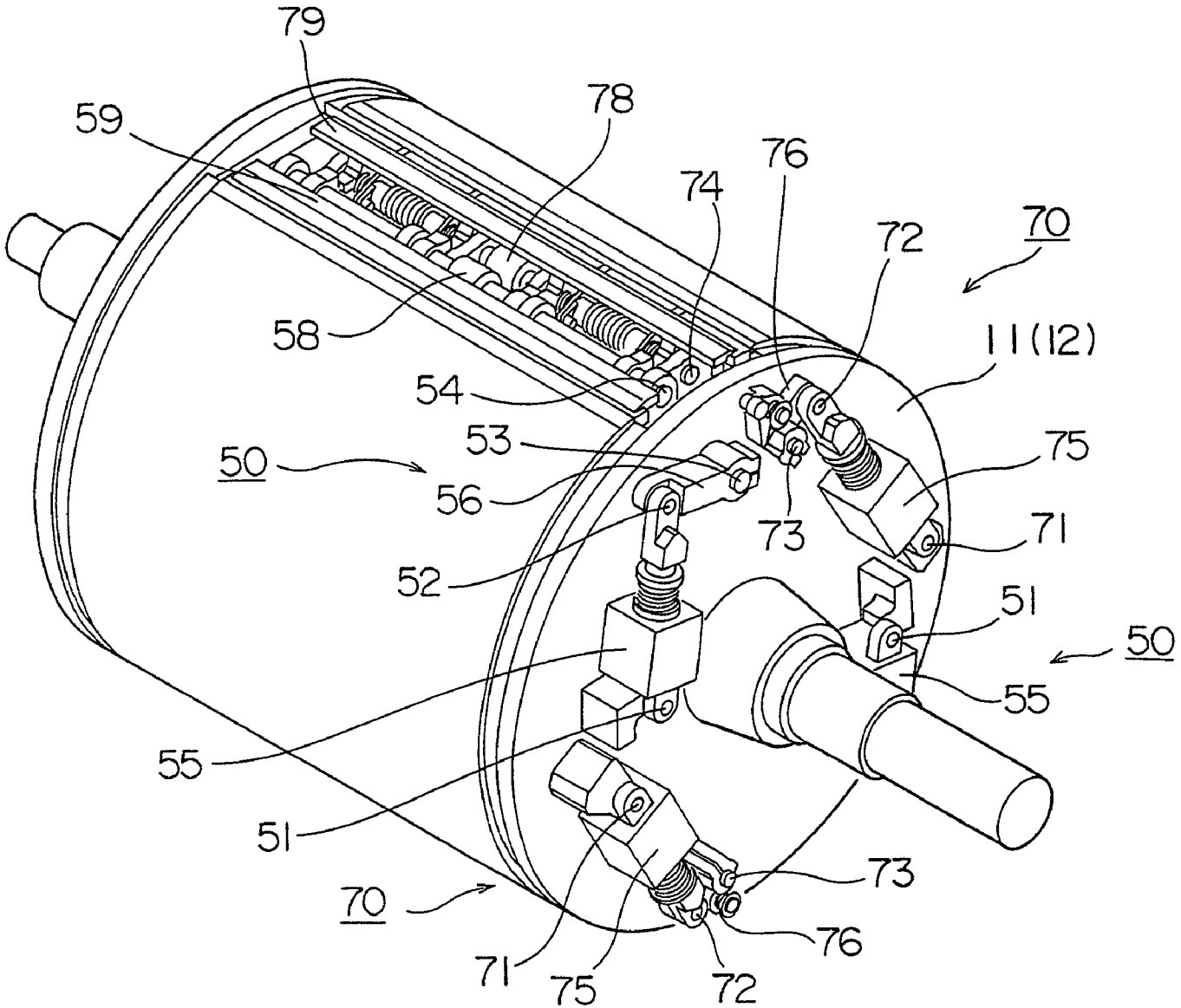
FIG. 2 is a perspective view showing forward end clamp mechanisms and rear end clamp mechanisms arranged on a first or second plate cylinder.
Figure 3:
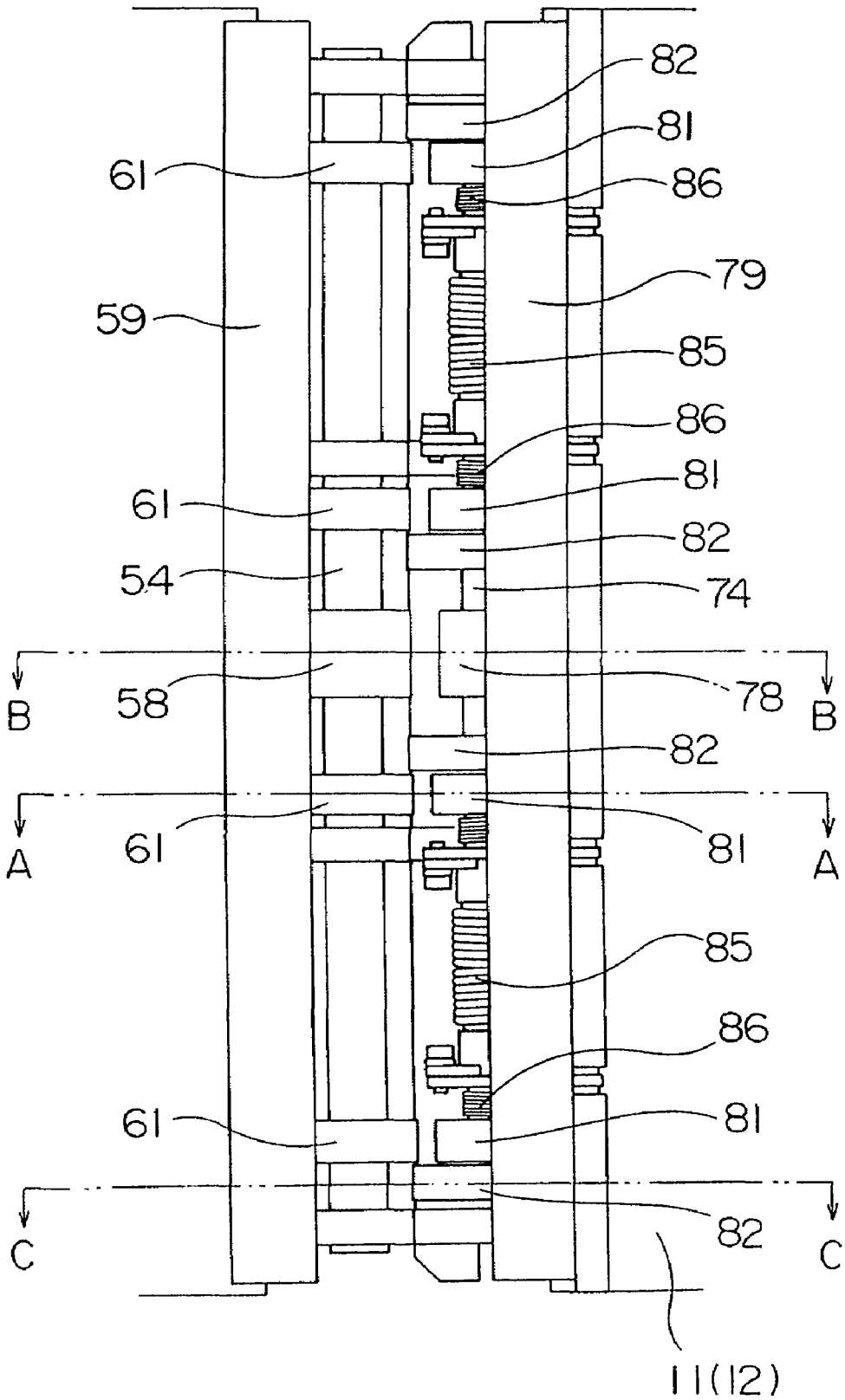
FIG. 3 is a front view showing one forward end clamp mechanism and one rear end clamp mechanism.

FIG. 2 is a perspective view showing forward end clamp mechanisms 50 and rear end clamp mechanisms 70 arranged on the first or second plate cylinder 11 or 12. FIG. 3 is a front view showing one of the forward end clamp mechanisms 50 and one of the rear end clamp mechanisms 70.

Each of the first and second plate cylinders 11 and 12 has forward end clamp mechanisms 50 for holding the forward ends of printing plates supplied by the plate feeder 100 or 200, and rear end clamp mechanisms 70 for holding the rear ends of the printing plates. In the printing apparatus in this embodiment, as noted hereinbefore, two printing plates are mounted peripherally of each of the first and second plate cylinders 11 and 12. Thus, each of the first and second plate cylinders 11 and 12 has two forward end clamp mechanisms 50 and two rear end clamp mechanisms 70. The forward end clamp mechanisms 50 are 180 degrees spaced from each other, and so are the rear end clamp mechanisms 70.

Figure 6:
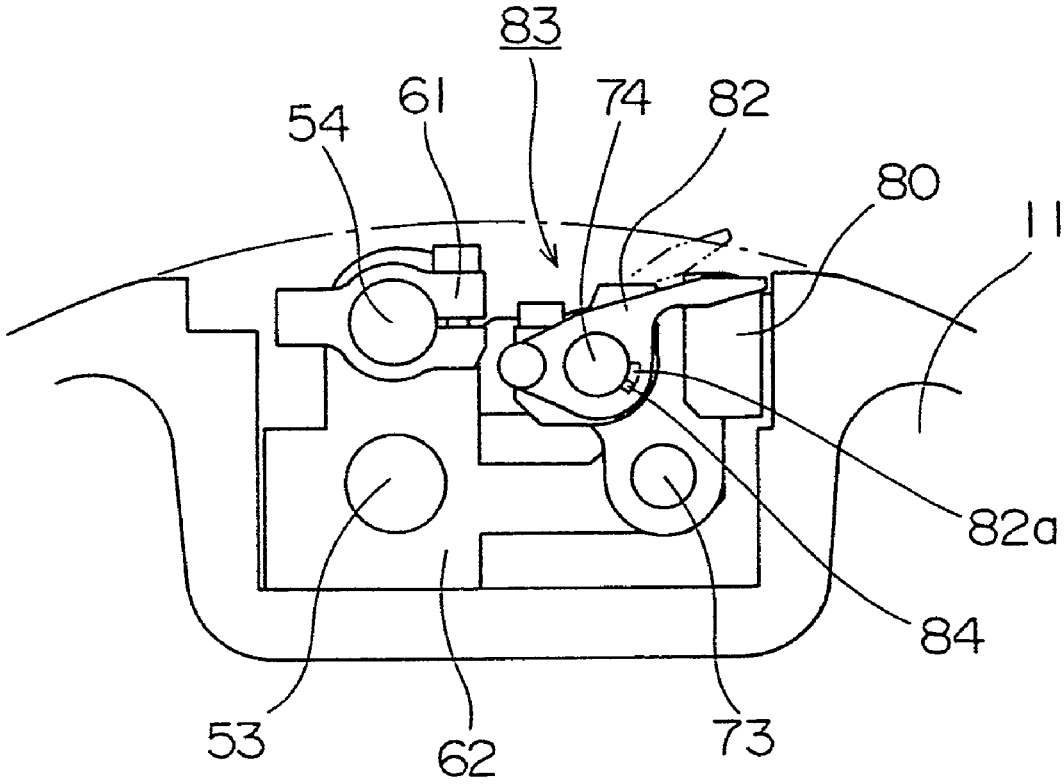
FIG. 6 is an explanatory view of a section taken on line C—C of FIG. 3.

Each forward end clamp mechanism 50 includes a forward end clamp 59, a clamp seat 60 and a forward end clamp opening and closing device. Each rear end clamp mechanism 70 includes a rear end clamp 79, a clamp seat 80, a rear end clamp opening and closing device, a stretching device and a pop-up device (FIG. 6). Each of the forward end clamp opening and closing device and the rear end clamp opening and closing device has one air cylinder 55 or 75 mounted on an end surface of the first or second plate cylinders 11 or 12.

Figure 4:
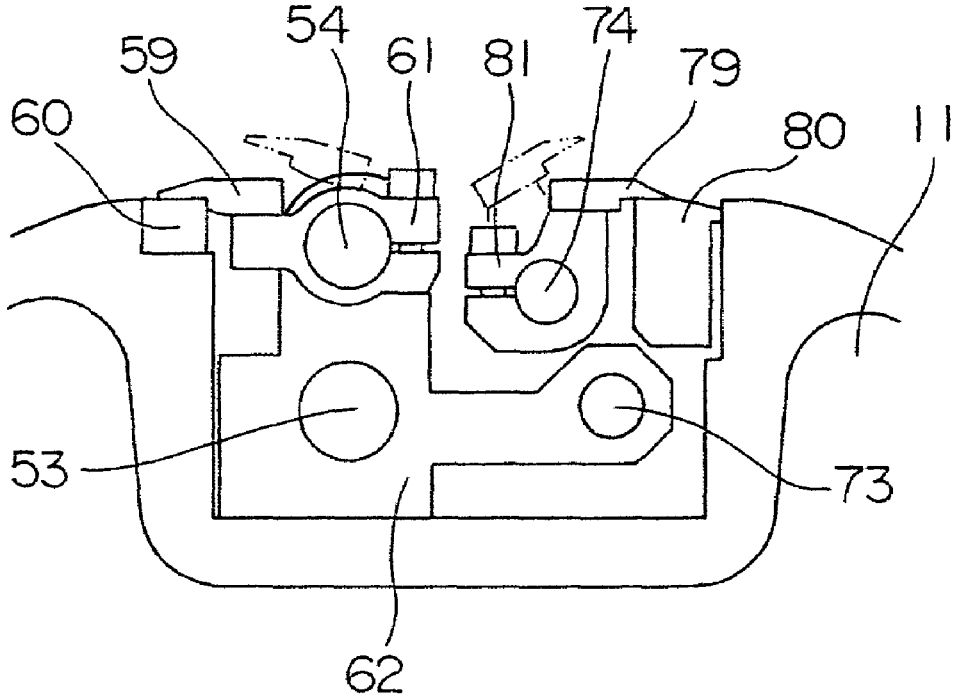
FIG. 4 is an explanatory view of a section taken on line A—A of FIG. 3.
Figure 5:
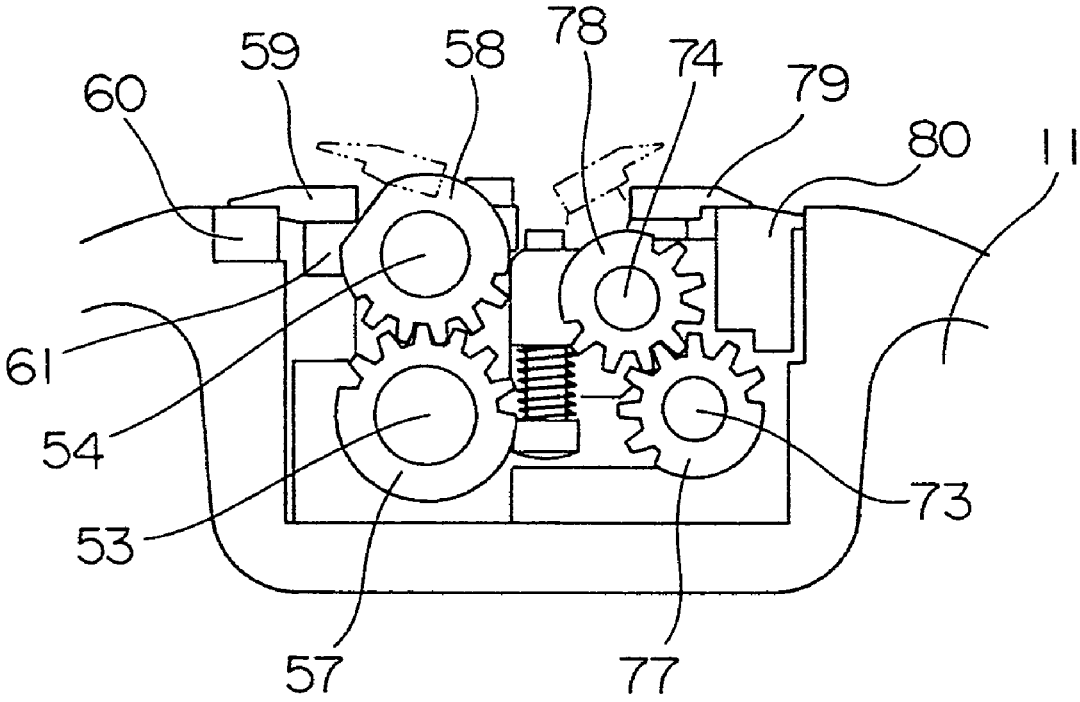
FIG. 5 is an explanatory view of a section taken on line B—B of FIG. 3.

FIG. 4 is an explanatory view of a section taken on line A—A of FIG. 3. FIG. 5 is an explanatory view of a section taken on line B—B of FIG. 3. FIG. 6 is an explanatory view of a section taken on line C—C of FIG. 3.

The forward end clamp opening and closing device of each forward end clamp mechanism 50 includes an air cylinder 55 acting as a drive source, a pin 51 for fixing the proximal end of the air cylinder 55 to the end surface of the first or second plate cylinder 11 or 12, a link 56 having an end pivotally connected by a pin 52 to a cylinder rod of the air cylinder 55, a shaft 53 fixed to the other end of the link 56 and extending axially of the first or second plate cylinder 11 or 12, a transmission gear 57 fixed to the shaft 53, a drive gear 58 meshed with the transmission gear 57, a shaft 54 having the drive gear 58 fixed thereto and extending axially of the first or second plate cylinder 11 or 12, and brackets 61 for fixedly connecting the shaft 54 and forward end clamp 59.

As shown in FIGS. 3 and 5, transmission gears 57 and 77 and drive gears 58 and 78 are arranged in a substantially middle region axially of the first or second plate cylinder 11 or 12. Thus, drive is transmitted to substantially middle regions of the forward end clamp 59 and rear end clamp 79. This arrangement can reduce a disagreement, axially of the first or second plate cylinder 11 or 12, in the timing of driving the forward end clamp 59 and rear end clamp 79. Though simple in construction, this allows the printing plates to be attached without being displaced axially of the first or second plate cylinder 11 or 12. Elastic elements 85 are mounted on a shaft 74 for biasing the rear end clamp 79 toward the clamp seat 80. Thus, even when the air cylinder 75 fails to function properly in time of recording an image, the rear end clamp 79 may be fixed to a position for contacting the clamp seat 80. The same construction may be employed also for the forward end clamp 59.

The forward end clamp opening and closing device is set such that, when the cylinder rod of the air cylinder 55 is extended, the forward end clamp 59 is positioned to contact the clamp seat 60 as shown in solid lines in FIGS. 4 and 5. When the cylinder rod of the air cylinder 55 is contracted from this state, the link 56 swings about the shaft 53 and rotates the shaft 53. As a result, the transmission gear 57 fixed to the shaft 53 rotates counterclockwise in FIG. 5. With this rotation of the transmission gear 57, the drive gear 58 meshed with the transmission gear 57 rotates clockwise in FIG. 5. This rotation of the drive gear 58 is transmitted to the forward end clamp 59 through the shaft 54 and brackets 61. Consequently, the forward end clamp 59 is moved away from the clamp seat 60 as shown in two-dot chain lines in FIGS. 4 and 5.

The rear end clamp opening and closing device of each rear end clamp mechanism 70 includes an air cylinder 75 acting as a drive source, a pin 71 for fixing the proximal end of the air cylinder 75 to the end surface of the first or second plate cylinder 11 or 12, a link 76 having an end pivotally connected by a pin 72 to a cylinder rod of the air cylinder 75, a shaft 73 fixed to the other end of the link 76 and extending axially of the first or second plate cylinder 11 or 12, a transmission gear 77 fixed to the shaft 73, a drive gear 78 meshed with the transmission gear 77, a shaft 74 having the drive gear 78 fixed thereto and extending axially of the first or second plate cylinder 11 or 12, and brackets 81 for fixedly connecting the shaft 84 and rear end clamp 79. The shafts 53, 54 and 73 are arranged by the same brackets 62 in predetermined positions of the first or second plate cylinder 11 or 12.

The rear end clamp opening and closing device is set such that, when the cylinder rod of the air cylinder 75 is extended, the rear end clamp 79 is positioned to contact the clamp seat 80 as shown in solid lines in FIGS. 4 and 5. When the cylinder rod of the air cylinder 75 is contracted from this state, the link 76 swings about the shaft 73 and rotates the shaft 73. As a result, the transmission gear 77 fixed to the shaft 73 rotates clockwise in FIG. 5. With this rotation of the transmission gear 77, the drive gear 78 meshed with the transmission gear 77 rotates counterclockwise in FIG. 5. This rotation of the drive gear 78 is transmitted to the rear end clamp 79 through the shaft 74 and brackets 81. Consequently, the rear end clamp 79 is moved away from the clamp seat 80 as shown in two-dot chain lines in FIGS. 4 and 5.

The stretching device of the rear end clamp mechanism 70 includes the shaft 73, and a fixing member, not shown, for fixing the shaft 73, shaft 74 and clamp seat 80. The fixing member is rotatably supported by the shaft 73. When the shaft 73 rotates after the rear end clamp 79 contracts the clamp seat 80, the fixing member rotates about the shaft 73 counterclockwise in FIG. 5, with the rear end clamp 79 contacting the clamp seat 80. As a result, the rear end of the printing plate pinched between the rear end clamp 79 and clamp seat 80 also rotates counterclockwise, whereby the printing plate is stretched.

As shown in FIG. 6, the pop-up device of the rear end clamp mechanism 70 includes pop-up elements 82, and pop-up element moving mechanisms 83 for moving the pop-up elements 82 between a depressed position having distal ends thereof disposed inwardly of the peripheral surface of the first or second plate cylinder 11 or 12 as shown in a solid line in FIG. 6, and a protruding position having the distal ends disposed outwardly of the peripheral surface of the first or second plate cylinder 11 or 12 as shown in a two-dot chain line in FIG. 6. Each pop-up element moving mechanism 83 includes the shaft 74, a pin 84 attached to the shaft 74, and an elastic element 86 (FIG. 3) for biasing the pop-up element 82 toward the depressed position.

Figure 7:
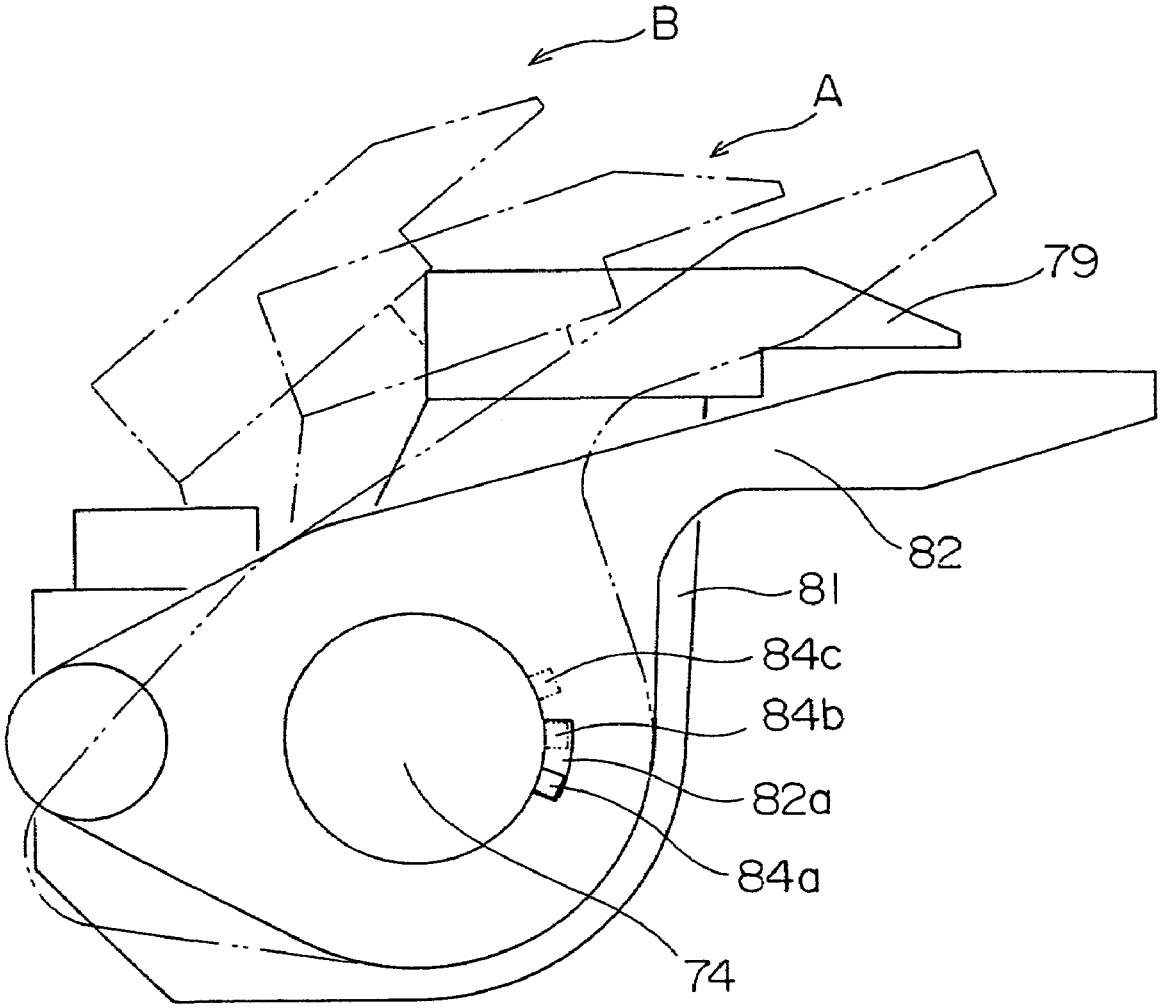
FIG. 7 is an explanatory view showing a principal portion of a pop-up device in enlargement.

FIG. 7 is an explanatory view showing a principal portion of the pop-up device in enlargement.

The illustrated pop-up element 82 defines a recess 82*a* shaped to correspond to the pin 84. When the rear end clamp 79 is in the position for contacting the clamp seat 80 as shown in solid lines in FIG. 7 and the pin 84 is placed in a position 84*a* at an extreme end of the recess 82*a* in the clockwise wise direction in FIG. 7, the rear end clamp 79 is also rotated about the shaft 74 to a position A in FIG. 7. In this state, the pop-up element 82 is placed in the depressed position by the biasing force of elastic element 86 (FIG. 3). When the shaft 74 rotates counterclockwise, the pin 84 is moved to a position 84*b* at the other extreme end of the recess 82*a*. When, in this state, the shaft 74 rotates further, the pop-up element 82 is pressed by the pin 84 counterclockwise to a protruding position shown in two-dot chain lines in FIG. 7. At this time, the rear end clamp 79 rotates further about the shaft 74 to a position B in FIG. 7.

The angle about the shaft 74 between the position 84*a* and position 84*b* is 22 degrees. The angle about the shaft 74 between the position 84*b* and position 84*c* is 20 degrees. Until the rear end clamp 79 rotates 22 degrees about the shaft 74 from the position contacting the clamp seat 80, the pop-up element 82 remains in the depressed position. With a further rotation of the shaft 74 after the pin 84 is placed in the position 84*b*, the rear end clamp 79 is rotated 20 degrees along with the pop-up element 82 about the shaft 74.

Figure 8:
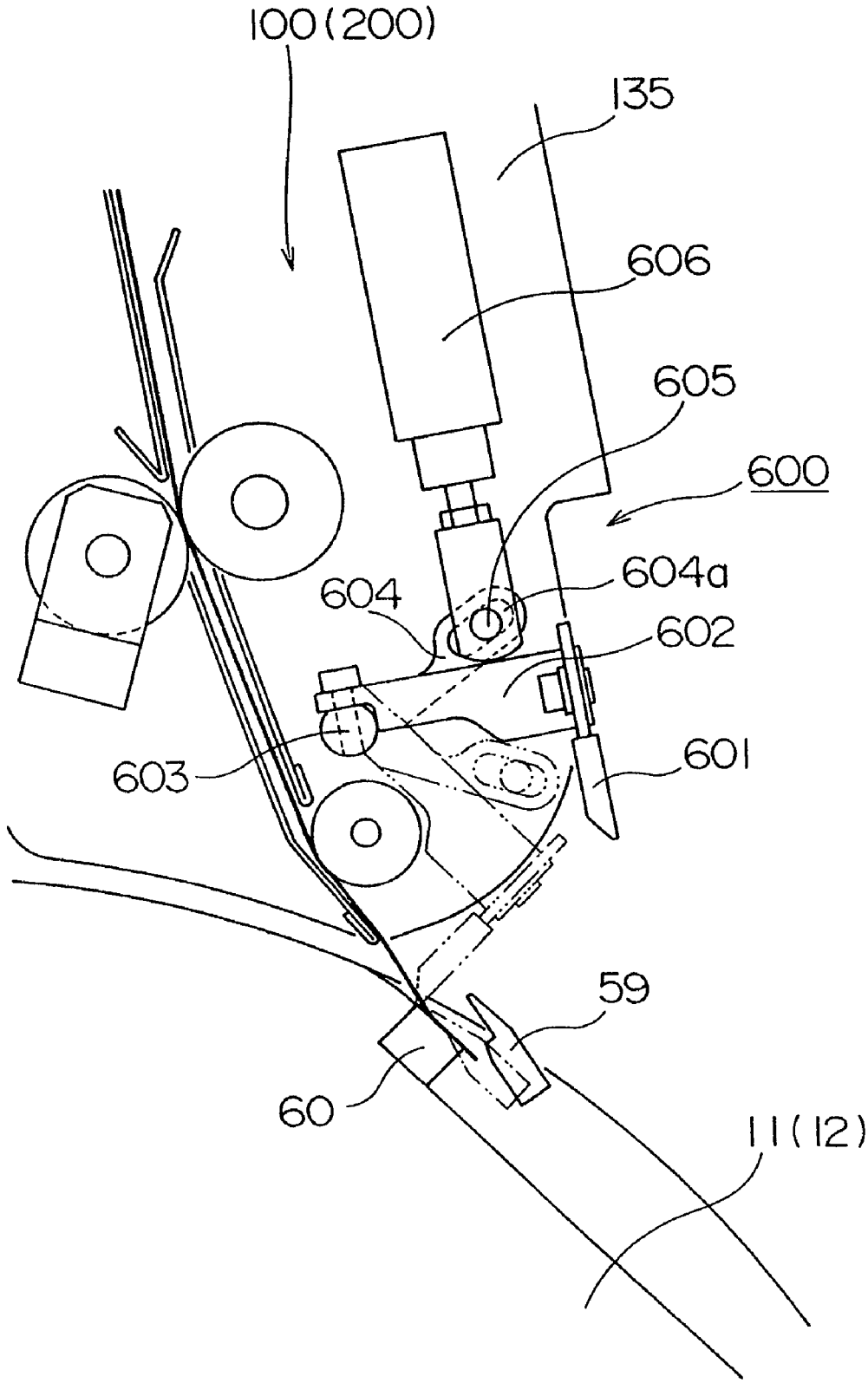
FIG. 8 is an explanatory side view showing a presser and a presser moving mechanism of a guide mechanism for guiding printing plates to the first or second plate cylinder.

FIG. 8 is an explanatory side view showing the presser 601 and presser moving mechanism 600 of the guide mechanism for guiding printing plates to the first or second plate cylinder 11 or 12.

The presser 601 has a function for assisting the forward end clamp mechanism 50 in an operation for clamping the printing plates. The presser 601 is constructed to press each printing plate transported from the storage cassette 43 upon the peripheral surface of the first or second plate cylinder 11 or 12 immediately before the printing plate is clamped by the forward end clamp mechanism 50.

The presser moving mechanism 600 includes an air cylinder 606 acting as a drive source, a pin 605 attached to a cylinder rod of the air cylinder 606, an arm 604 defining a slot 604*a* for engaging the pin 605, a rotary shaft 603 for supporting the arm 604 to be pivotable relative to the support member 135 of the plate feeder 100, and an arm 602 connecting the rotary shaft 603 and presser 601. With this construction, when the cylinder rod of the air cylinder 606 is contracted, the presser 601 is placed in the position spaced from the peripheral surface of the first or second plate cylinder 11 or 12 as shown in FIG. 8. When the cylinder rod of the air cylinder 606 is extended, the presser 601 is moved to the position contacting the peripheral surface of the first or second plate cylinder 11 or 12.

In the printing apparatus with the guide mechanism having the above construction, when attaching a printing plate to the peripheral surface of the first or second plate cylinder 11 or 12, the forward end of the printing plate is first transported to the forward end clamp mechanism 50 of the first or second plate cylinder 11 or 12. The forward end of the printing plate is inserted between the forward end clamp 59 and clamp seat 60, with the forward end clamp 59 being in the position away from the clamp seat 60. When the forward end of the printing plate has been inserted between the forward end clamp 59 and clamp seat 60, the presser moving mechanism 600 moves the presser 601 to the position for contacting the peripheral surface of the first or second plate cylinder 11 or 12. As a result, the printing plate is pinched between the first or second plate cylinder 11 or 12 and the presser 601. In this state, the forward end clamp 59 is moved to the position to contact the clamp seat 60 and pinch the forward end of the printing plate with the clamp seat 60. Once the forward end of the printing plate is pinched between the forward end clamp 59 and clamp seat 60, the presser 601 is moved away from the peripheral surface of the first or second plate cylinder 11 or 12.

With the forward end of the printing plate held by the forward end clamp mechanism 50 as described above, the printing plate may be attached without being displaced.

Figure 9:
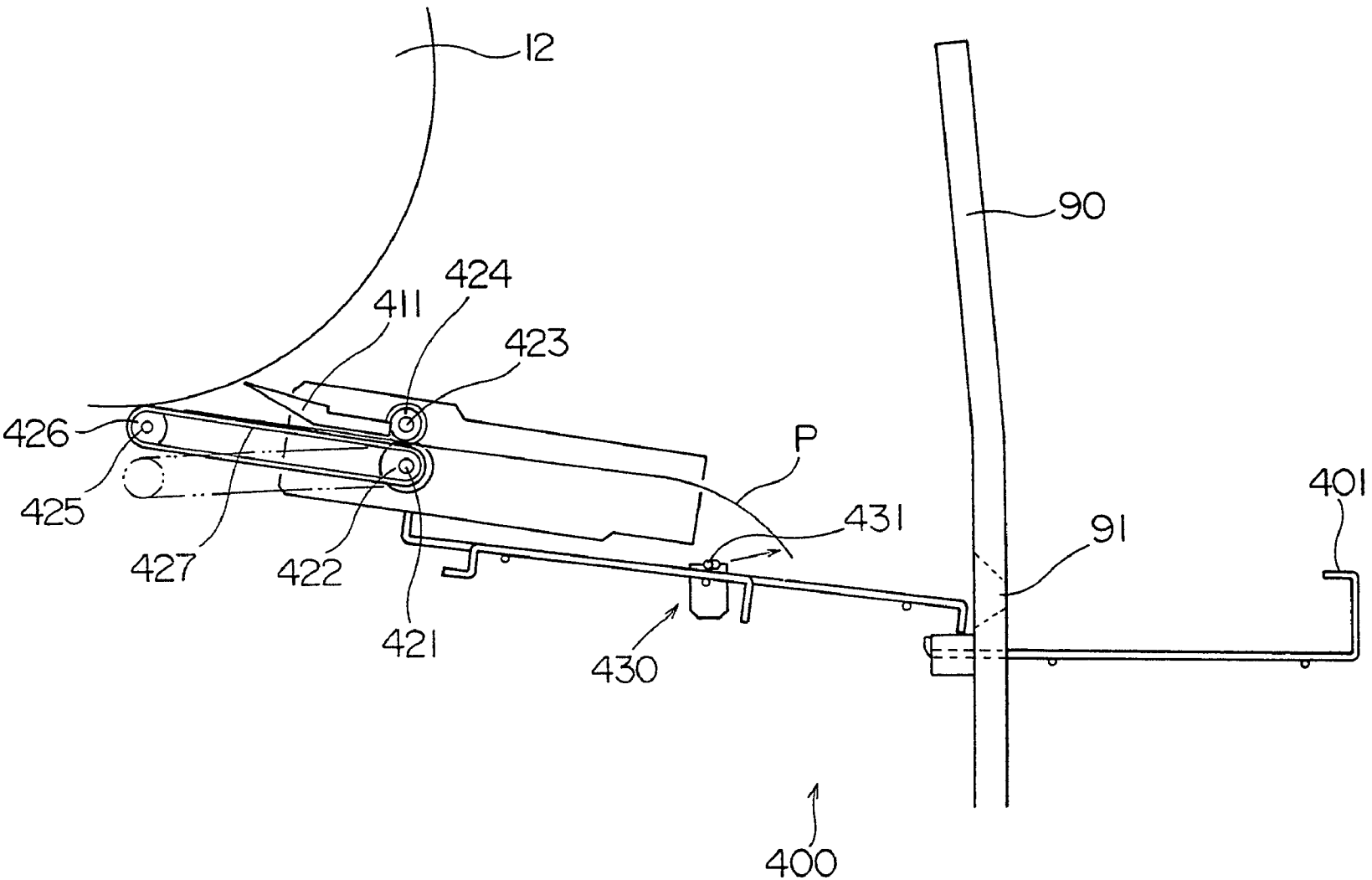
FIG. 9 is a side view of a plate discharger of the printing apparatus in the first embodiment.
Figure 10:
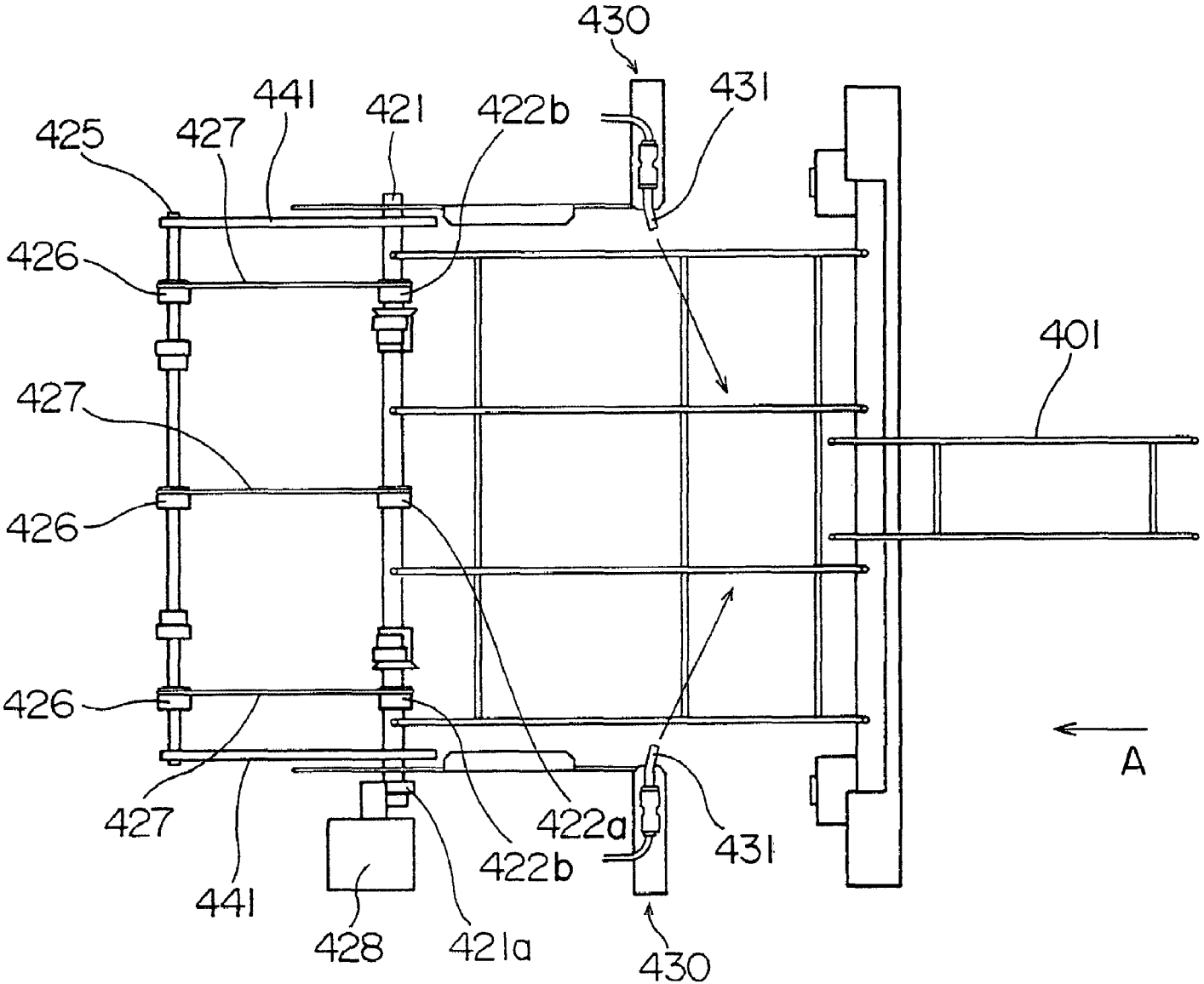
FIG. 10 is a plan view of the plate discharger.

FIG. 9 is a side view of the plate discharger 400 of the printing apparatus in the first embodiment. FIG. 10 is a plan view of the plate discharger 400. The plate discharger 300 has the same construction as the plate discharger 400, and its description will be omitted.

This plate discharger 400 includes a peeling claw 411, a transport device for discharging a printing plate P peeled by the peeling claw 411 to the plate discharge cassette 401, and an air blowing device 430 for blowing air to the undersurface of the printing plate P passing through a transport path.

The transport device transports and discharges the printing plate P to the plate discharge cassette 401 through the transport path extending between the second plate cylinder 12 and plate discharge cassette 401. The transport device includes a rotary shaft 421, first transport rollers 422 rotatable on the rotary shaft 421, a driven rotary shaft 423 disposed laterally of the first transport rollers 422, second transport rollers 424 rotatable on the driven rotary shaft 423, peeling rollers 426 rotatable on a rotary shaft 425, and belts 427 wound around the first transport rollers 422 and peeling rollers 426. The driven rotary shaft 423 is connected to a drive gear, not shown, rotatably meshed with a transmission gear not shown.

The first transport rollers 422 and second transport rollers 424 are arranged adjacent each other for pinching the printing plate P therebetween. The rotary shaft 421 is connected to a motor 428 through a gear 421*a* to be rotatable with rotation of the motor 428. The rotation of this rotary shaft 421 rotates the first transport rollers 422 which in turn rotates the driven rotary shaft 423 and second transport rollers 424 through the transmission gear and drive gear.

Of the first transport rollers 422 arranged in the direction of width of the printing plate P (in the vertical direction in FIG. 10), the end rollers 422*b* have a larger diameter than the middle roller 422*a*. The second transport rollers 424 are arranged between the first transport rollers 422 (i.e. inwardly of the first transport rollers 422*b*) for contacting transversely intermediate positions of the printing plate P. Consequently, the printing plate P can be transported as curved into a U- or V-shape when seen from the direction of arrow A in FIG. 10. The printing plate P is thereby maintained firm, with the forward end thereof prevented from drooping.

Figure 12:
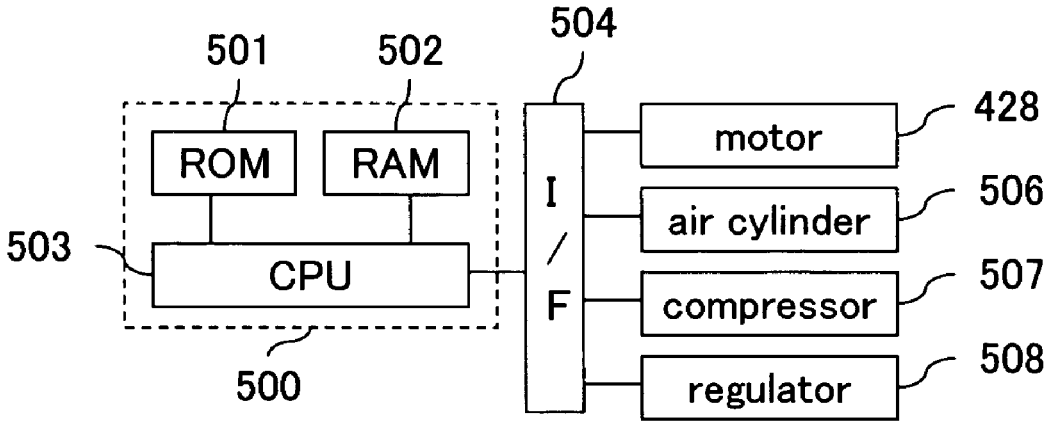
FIG. 12 is a block diagram showing a principal electrical structure of the plate discharger.

The rotary shaft 421 and rotary shaft 425 are fixed by links 441. These links 441 are connected to the cylinder rod of an air cylinder 506 (FIG. 12). The rotary shaft 425, peeling rollers 426 and belts 427 are pivotable about the rotary shaft 421 by extension and contraction of the air cylinder 506.

The peeling claw 411 is provided for peeling off the printing plate P mounted peripherally of the second plate cylinder 12. The peeling claw 411 is fixed to the links 441, to be pivotable with the links 441 about the rotary shaft 421 by extension and contraction of the air cylinder 506.

Thus, the peripheries of the peeling rollers 426 and the forward end of the peeling claw 411 are pivotable about the rotary shaft 421 between a position adjacent the second plate cylinder 12 as shown in solid lines in FIG. 9 and a position spaced away from the second plate cylinder 12 as shown in two-dot chain lines in FIG. 9. In this way, the peeling device is prevented from interfering with the printing plates mounted on the plate cylinders during a printing or plate-making operation.

The air blowing device 430 is arranged to blow air to the undersurface of the printing plate P in positions downstream of the first transport rollers 422 and second transport rollers 424 with respect to the direction in which of the printing plate P is transported by the transport device. The air blowing device 430 includes a compressor 507 (FIG. 12) acting as an air source, and air nozzles 431 connected to the compressor 507.

A side wall 90 is disposed between the first and second transport rollers 422 and 424, and the plate discharge cassette 401. The plate discharge cassette 401 is fixed to the side wall 90. The side wall 90 defines an opening 91 for passage of the printing plate P.

Figure 11:
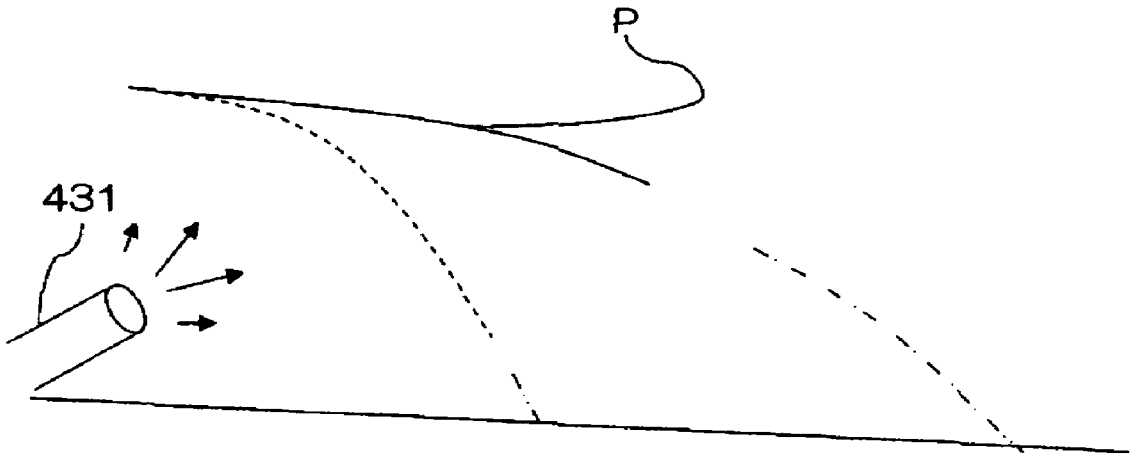
FIG. 11 is an explanatory view showing a state of air being blown from an air nozzle to a printing plate discharged to a plate discharge cassette.

FIG. 11 is an explanatory view showing a state of air being blown from the air nozzles 431 to the printing plate P to be discharged to the plate discharge cassette 401. In FIG. 11, the dotted line shows a state where air is not blown from the air nozzles 431 to the printing plate P.

The air nozzles 431 are arranged to have tip ends lying downstream in the direction of transport of the printing plate P, and directed slightly upward. The air nozzles 431 blow air in directions indicated by arrows in FIGS. 9, 10 and 11 to the undersurface of the printing plate P to be discharged to the plate discharge cassette 401. The air applies a lifting force to the undersurface of the printing plate P to be discharged. Thus, when air is blown from the air nozzles 431, the forward end of the printing plate P touches down further downstream in the direction of transport of the printing plate P than when air is not blown from the air nozzles 431. Consequently, the printing plate P discharged to the plate discharge cassette 401 has a reduced range of contact with a printing plate already stored in the plate discharge cassette 401.

FIG. 12 is a block diagram showing a principal electrical structure of the plate discharger 400. This plate discharger 400 includes a control unit 500 having a ROM 501 for storing operating programs necessary for controlling the discharger, a RAM 502 for temporarily storing data and the like during a control operation, and a CPU 503. The control unit 500 generates driving signals and applies the signals through an interface 504 to the motor 428 for rotating the rotary shaft 421, the air cylinder 506 acting as the power source for swinging the peeling rollers 426, the compressor 507 acting as the air source for the air blowing device 430, and a regulator 508.

The regulator 508 is provided for adjusting a flow rate of air spouted from the compressor 507. By operating the regulator 508, the flow rate of air blown from the air nozzles 431 may be adjusted according to the size, weight, flexibility, discharge speed and so on of the printing plate P. With the above construction, the plate discharger 400 is controlled by the control unit 500.

Figure 13A:
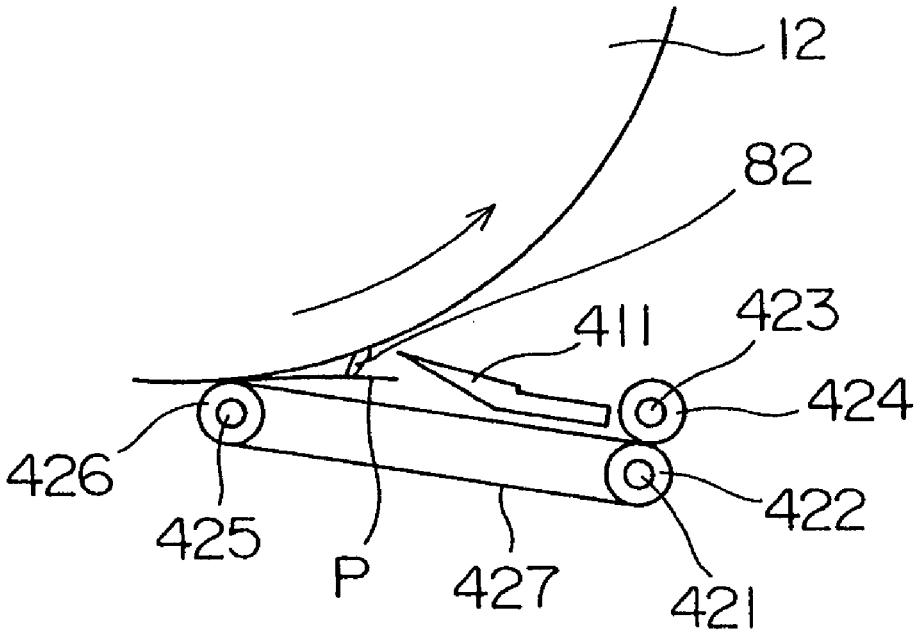
FIG. 13A is an explanatory view showing a state of a printing plate being peeled from the peripheral surface of the second plate cylinder.
Figure 13B:
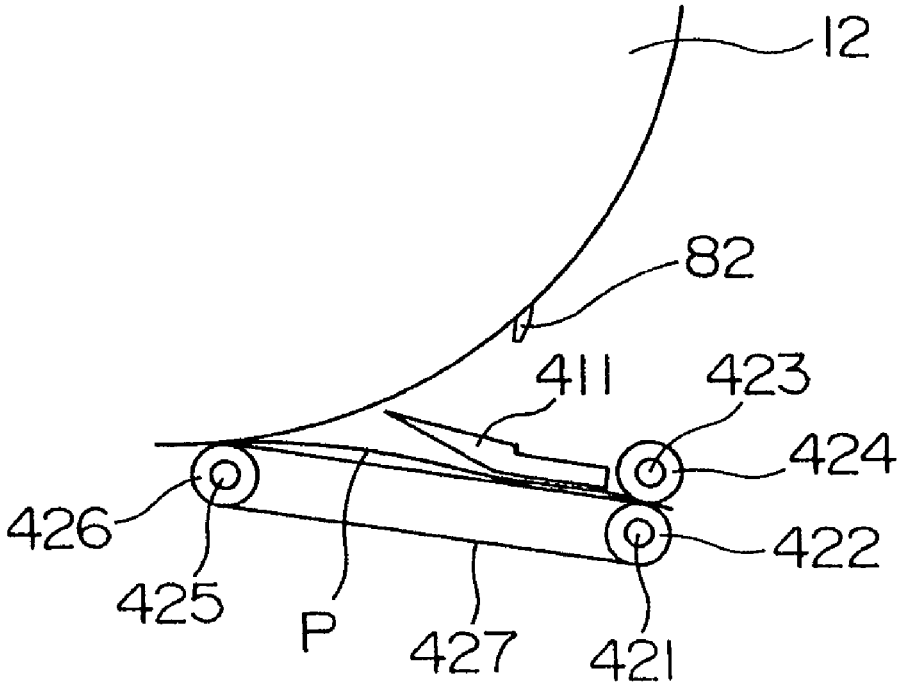
FIG. 13B is an explanatory view showing a state of the printing plate being peeled from the peripheral surface of the second plate cylinder.

FIGS. 13A and 13B are explanatory views showing a state of the printing plate P being peeled from the peripheral surface of the second plate cylinder 12.

The plate discharger 400 having the above construction detaches used printing plates P mounted peripherally of the second plate cylinder 12 from the second plate cylinder 12 and discharges the printing plates P to the plate discharge cassette 401 which stores the printing plates P as successively stacked one upon the other. First, as shown in FIG. 13A, the pop-up element 82 described hereinbefore is set to the protruding position shown in the two-dot chain lines in FIGS. 6 and 7. As a result, an end of the printing plate P is ejected off the peripheral surface of the second plate cylinder 12.

As the second plate cylinder 12 rotates in the direction indicated by an arrow in FIG. 13A, the end of the printing plate P ejected enters between the peeling claw 411 and belts 427. At this time, the rotary shaft 421 is rotated by the motor 428. The rotation of the rotary shaft 421 rotates the first transport rollers 422, which in turn rotates the second transport rollers 424. The rotation of the first transport rollers 422 swings the belts 427. Consequently, the end of the printing plate P is transported in the direction of the first transport rollers 422 and second transport rollers 424. As shown in FIG. 13B, the printing plate P is pinched between and transported by the first transport rollers 422 and second transport rollers 424. As the printing plate P passes between the first transport rollers 422 and second transport rollers 424, the air blowing device 430 shown in FIGS. 9 and 10 blows air to the undersurface of the printing plate P. This applies a lifting force to the printing plate P upward in FIG. 9. The undersurface of the printing plate P can possibly avoid contact with the surface of a printing plate already placed in the plate discharge cassette 401. Thus, the surface tension of ink and water adhering to the undersurface of the printing plate P produced through contact with another printing plate is reduced, thereby avoiding errors in transportation of the printing plate P.

When the printing plate P has been discharged to the plate discharge cassette 401, the air cylinder 506 is contracted to swing the rotary shaft 425, peeling rollers 426 and belts 427 about the rotary shaft 421. As a result, the peripheries of the peeling rollers 426 and the forward end of the peeling claw 411 move to the position spaced away from the second plate cylinder 12 as shown in the two-dot chain lines in FIG. 9. Thus, the peeling device is prevented from interfering with a next printing plate P, if any, mounted peripherally of the second plate cylinder 12.

Figure 14:
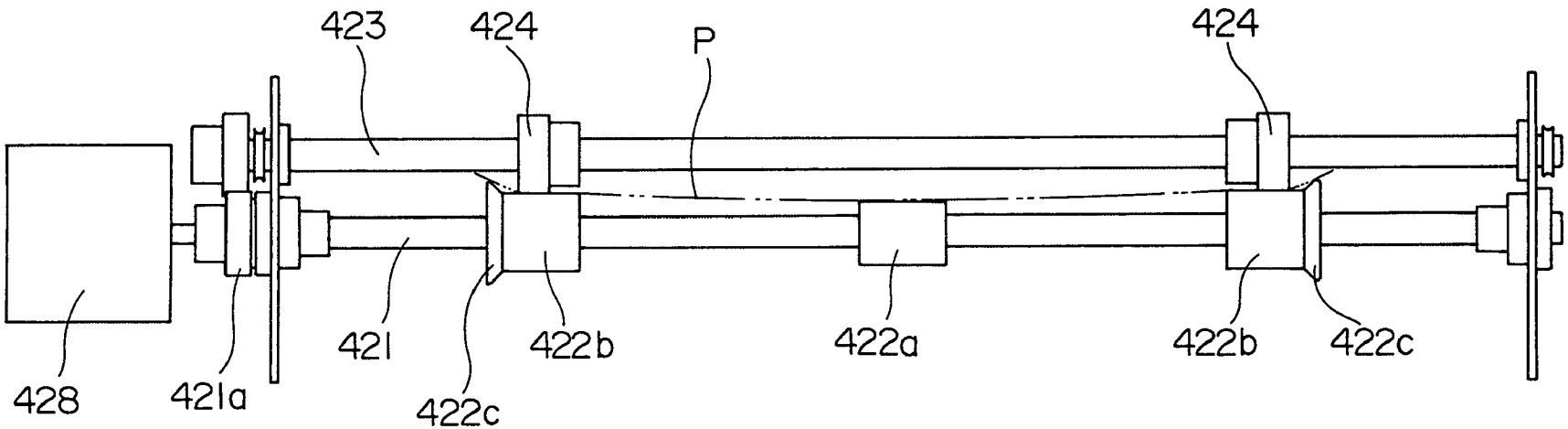
FIG. 14 is an explanatory side view of first transport rollers and second transport rollers of a printing apparatus in a second embodiment of the invention.

FIG. 14 is an explanatory view, seen from the direction of arrow A in FIG. 10, showing first transport rollers 422 and second transport rollers 424 in a printing apparatus in a second embodiment of this invention.

In the first embodiment, the first transport rollers 422 arranged in the direction perpendicular to the direction of transport of the printing plate P include end rollers 422*b* having a larger diameter than the middle roller 422*a*. The second embodiment further includes push-up elements 422*c* arranged at ends of the first transport rollers 422*b* to act as a push-up device for pushing up the printing plate P. The push-up elements 422*c* are rotatable about the same rotary shaft 421 as the first transport rollers 422*a* and 422*b*. The printing plate P transported by the first transport rollers 422 and second transport rollers 424 is held inwardly of the push-up elements 422*c*.

According to the printing apparatus in the second embodiment, the printing plate P can be transported as curved into a U- or V-shape as shown in a two-dot chain line in FIG. 14. This is effective to reduce drooping of the forward end of printing plate P.

While the push-up elements 422*c* in the second embodiment described above are rotatable about the same rotary shaft 421 as the first transport rollers 422*a* and 422*b*, the apparatus may be modified such that the push-up elements 422*c* are rotatable about a different rotary shaft disposed in substantially the same position as or downstream of the first transport rollers 422*a* and 422*b* with respect to the direction of transport of the printing plate P. The push-up elements 422*c* will serve the purpose as long as these elements 422*c* have the function to push up ends of the printing plate P in substantially the same position as or downstream of the first transport rollers 422*a* and 422*b* with respect to the direction of transport of the printing plate P, and may be fixed directly to a side wall or the like of the printing apparatus.

In the embodiments described hereinbefore, the first transport rollers 422*b* have a larger diameter than the first transport roller 422*a*. Instead, the first transport rollers 422*a* and 422*b* may have the same diameter.

In the embodiments described hereinbefore, the second transport rollers 424 are rotatable by rotation of the first transport rollers 422. It is not absolutely necessary for the second transport rollers 424 to be rotatable by rotation of the first transport rollers 422. The second transport rollers 424 will serve the purpose as long as they are rotatable synchronously with the first transport rollers 422.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2004-129347 filed in the Japanese Patent Office on 26 Apr. 2004, the entire disclosure of which is incorporated herein by reference, and Japanese Patent Application No. 2005-005826 filed in the Japanese Patent Office on 13 Jan. 2005, the entire disclosure of which is incorporated herein by reference.

What is claimed is:

1. A printing apparatus having a plate discharge mechanism for removing used printing plates mounted peripherally of a plate cylinder from the plate cylinder, and discharging the printing plates to a plate discharge station that successively stores the printing plate as stacked one after another, said plate discharge mechanism comprising:

a transport unit configured for passing said printing plates through a transport path disposed between said plate cylinder and said plate discharge station to discharge said printing plates to said plate discharge station; and an air blowing unit configured for blowing air to an undersurface of each of the printing plates passing through said transport path, wherein said transport unit includes:

a rotary shaft;

a first transport roller rotatable about said rotary shaft;

a second transport roller rotatable synchronously with rotation of said first transport roller and arranged to pinch said printing plates with said first transport roller; and a push-up unit arranged in substantially the same position as or downstream of said first transport roller with respect to a direction of transport of said printing plates, for pushing up transversely opposite ends of said printing plates.

2. A printing apparatus as defined in claim 1, wherein said air blowing unit is arranged to blow air at least to the undersurface in a forward region of each of the printing plates passing through said transport path.

3. A printing apparatus as defined in claim 1, wherein said air blowing unit is arranged to blow air in a way to prevent a forward end of each of the printing plates from contacting a printing plate already stored in said plate discharge station.

4. A printing apparatus as defined in claim 1, wherein said air blowing unit includes:

an air source for generating air; and air nozzles connected to said air source for blowing air to the undersurface of each of the printing plates passing through said transport path.

5. A printing apparatus as defined in claim 4, wherein each of said air nozzles is arranged to have a tip end thereof directed downstream with respect to a direction of transport of said printing plates.

6. A printing apparatus as defined in claim 4, further comprising a controller configured for adjusting a flow rate of air blown from said air nozzles.

7. A printing apparatus as defined in claim 1, further comprising a peeling unit for peeling the printing plates mounted peripherally of said plate cylinder from said plate cylinder, wherein said transport unit is arranged to pass said printing plates peeled by said peeling unit, through the transport path disposed between said plate cylinder and said plate discharge station to discharge said printing plates to said plate discharge station.

8. A printing apparatus as defined in claim 7, wherein said transport unit further includes:

a peeling roller pivotable about said rotary shaft between a position adjacent said plate cylinder and a position spaced away from said plate cylinder; and a belt wound around said first transport roller and said peeling roller.

9. A printing apparatus as defined in claim 8, further comprising a pop-up unit arranged on said plate cylinder to be movable between a position contained inwardly of a peripheral surface of said plate cylinder and a position protruding from the peripheral surface of said plate cylinder for removing said printing plates mounted peripherally of the plate cylinder.

10. A printing apparatus as defined in claim 8, wherein said peeling unit includes a peeling claw having a distal end thereof pivotable with said peeling roller about said rotary shaft between the position adjacent said plate cylinder and the position spaced away from said plate cylinder.

11. A printing apparatus having a plate discharge mechanism for removing used printing plates mounted peripherally of a plate cylinder from the plate cylinder, and discharging the printing plates to a plate discharge station that successively stores the printing plate as stacked one after another, said plate discharge mechanism comprising:

a transport unit configured for passing said printing plates through a transport path disposed between said plate cylinder and said plate discharge station to discharge said printing plates to said plate discharge station; and an air blowing unit for blowing air to an undersurface of each of the printing plates passing through said transport path, wherein said transport unit includes:

a rotary shaft;

a first transport roller rotatable about said rotary shaft, and having a larger diameter at opposite ends than in an intermediate portion thereof transversely of said printing plates; and a second transport roller rotatable synchronously with rotation of said first transport roller and arranged to pinch said printing plates with said first transport roller in portions of said printing plates between said opposite ends of said first transport roller.

12. A printing apparatus as defined in claim 11, wherein said air blowing unit is arranged to blow air at least to the undersurface in a forward region of each of the printing plates passing through said transport path.

13. A printing apparatus as defined in claim 11, wherein said air blowing unit is arranged to blow air in a way to prevent a forward end of each of the printing plates from contacting a printing plate already stored in said plate discharge station.

14. A printing apparatus as defined in claim 11, wherein said air blowing unit includes:

an air source for generating air; and air nozzles connected to said air source for blowing air to the undersurface of each of the printing plates passing through said transport path.

15. A printing apparatus as defined in claim 14, wherein each of said air nozzles is arranged to have a tip end thereof directed downstream with respect to a direction of transport of said printing plates.

16. A printing apparatus as defined in claim 14, further comprising a controller configured for adjusting a flow rate of air blown from said air nozzles.

17. A printing apparatus as defined in claim 11, further comprising a peeling unit for peeling the printing plates mounted peripherally of said plate cylinder from said plate cylinder, wherein said transport unit is arranged to pass said printing plates peeled by said peeling unit, through the transport path disposed between said plate cylinder and said plate discharge station to discharge said printing plates to said plate discharge station.

18. A printing apparatus as defined in claim 17, wherein said transport unit further includes:

a peeling roller pivotable about said rotary shaft between a position adjacent said plate cylinder and a position spaced away from said plate cylinder; and a belt wound around said first transport roller and said peeling roller.

19. A printing apparatus as defined in claim 18, further comprising a pop-up unit arranged on said plate cylinder to be movable between a position contained inwardly of a peripheral surface of said plate cylinder and a position protruding from the peripheral surface of said plate cylinder for removing said printing plates mounted peripherally of the plate cylinder.

20. A printing apparatus as defined in claim 18, wherein said peeling unit includes a peeling claw having a distal end thereof pivotable with said peeling roller about said rotary shaft between the position adjacent said plate cylinder and the position spaced away from said plate cylinder.

* * * * *